United States Patent [19]

Pessagno

[11] 3,933,088

[45] Jan. 20, 1976

[54] NEWSPAPER AND MAGAZINE STORAGE DEVICE

[75] Inventor: Mary A. Pessagno, Fremont, Calif.

[73] Assignee: The Raymond Lee Organization, Inc., New York, N.Y. ; a part interest

[22] Filed: Sept. 3, 1974

[21] Appl. No.: 502,438

[52] U.S. Cl. ..... 100/34

[51] Int. Cl.[2] ..... B65B 13/18

[58] Field of Search ..... 100/1, 2, 25, 34; 211/50

[56] References Cited

UNITED STATES PATENTS

| | | | |
|---|---|---|---|
| 315,044 | 4/1885 | Luce et al. | 100/34 |
| 2,636,432 | 4/1953 | Sherer | 100/34 |
| 2,839,990 | 6/1958 | Bailar | 100/1 |
| 3,498,214 | 3/1970 | Bailey | 100/34 |
| 3,826,186 | 7/1974 | Mechler | 100/25 |

*Primary Examiner*—Billy J. Wilhite
*Attorney, Agent, or Firm*—Daniel Jay Tick

[57] ABSTRACT

A newspaper and magazine storage device for storing and disposing of a plurality of newspapers and magazines comprises a rectangular plate-like support member. A pair of tubular members are affixed to the top of the support member and cross each other on top of the support member at right angles to each other. Each tubular member extends along a corresponding axis of the support member. Each tubular member has a U-shaped configuration with a head part affixed to the support member and a pair of arms extending perpendicularly from the ends of the head part and extending perpendicularly to the plane of the support member. Each of the tubular members has a slit formed therein along the length thereof for accommodating cord-like binding material in each of the tubular members, and each of the tubular members is curved at both its free ends in a substantially hook-like configuration.

2 Claims, 5 Drawing Figures

NEWSPAPER AND MAGAZINE STORAGE DEVICE

DESCRIPTION OF THE INVENTION:

The present invention relates to a newspaper and magazine storage device.

More particularly, the invention relates to a newspaper and magazine storage device for storing and disposing of a plurality of newspapers and magazines.

Objects of the invention are to provide a newspaper and magazine storage device of simple structure, which is inexpensive in manufacture, provides temporary storage for newspapers and magazines, permits disposal of newspapers and magazines with facility and convenience, permits bundles of newspapers and magazines to be stored with facility, convenience, neatness and rapidity, and is efficient, effective and reliable in operation.

In order that the invention may be readily carried into effect, it will now be described with reference to the accompanying drawing, wherein.

In the FIGS., the same components are identified by the same reference numerals.

Figure 1:
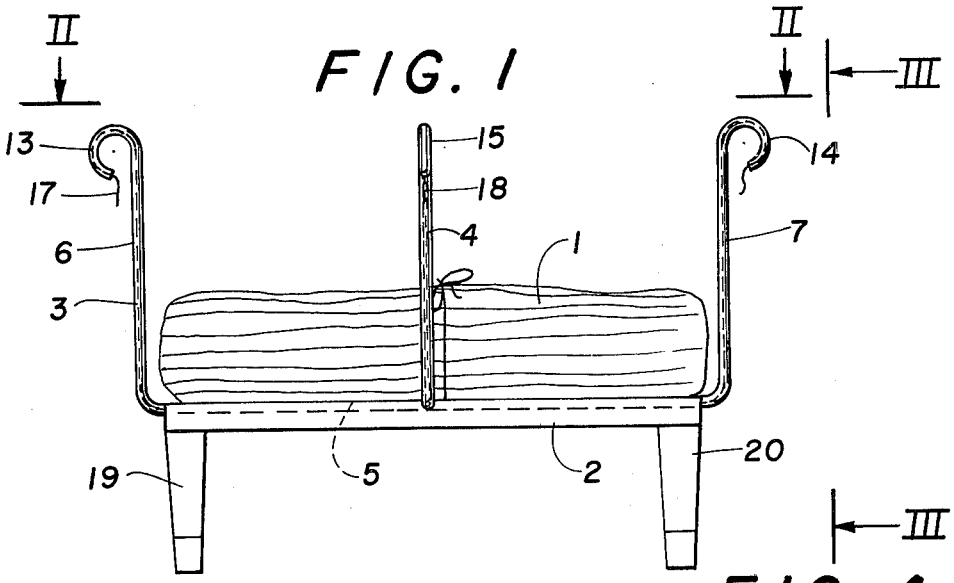
FIG. 1 is a side view of an embodiment of the newspaper and magazine storage device of the invention.
Figure 2:
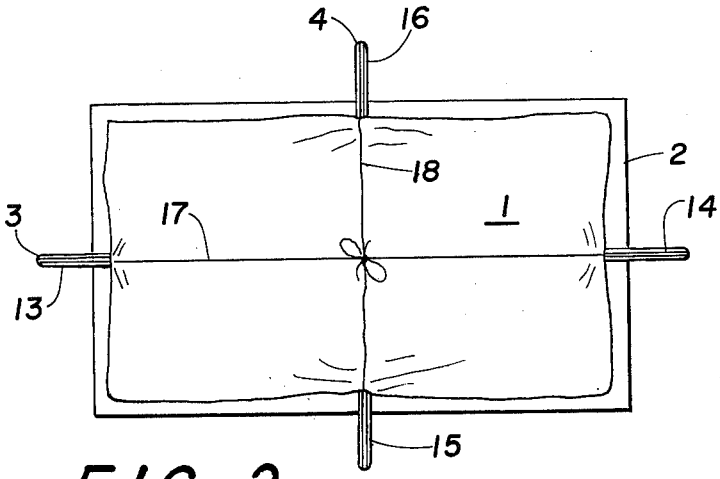
FIG. 2 is a view, taken along the lines II — II, of FIG. 1.

The newspaper and magazine storage device of the invention stores and disposes of a plurality of newspapers and magazines 1 (FIGS. 1 and 2).

Figure 3:
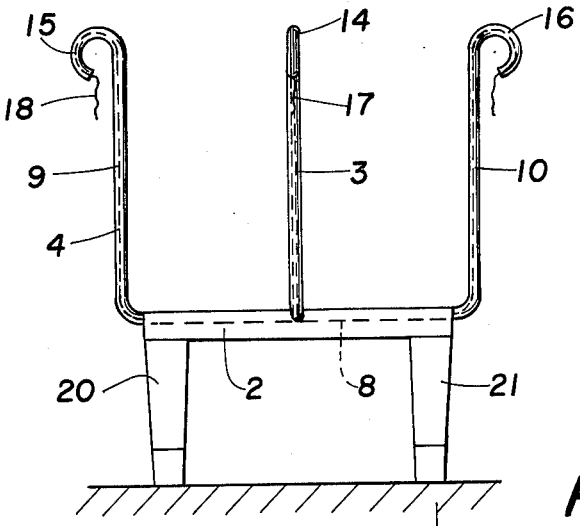
FIG. 3 is a view, taken along the lines III — III, of FIG. 1.

The storage device of the invention comprises a substantially rectangular plate-like support member 2 (FIGS. 1 to 3).

A pair of tubular members 3 and 4 (FIGS. 1 to 3) are affixed to the top of the support member 2 and cross each other on top of the support member at substantially right angles to each other. Each tubular member 3 and 4 extends along a corresponding axis of the support member. Each tubular member 3 and 4 has a substantially U-shaped configuration with a head part affixed to the support member 2 and a pair of arms extending substantially perpendicularly from the ends of the head part and extending substantially perpendicularly to the plane of the support member. Thus, the tubular member 3 is of substantially U-shaped configuration with a head part 5 (FIG. 1) affixed to the support member 2 and a pair of arms 6 and 7 extending substantially perpendicularly from the ends of the head part 5 and extending substantially perpendicularly to the plane of the support member. The tubular member 4 is of substantially U-shaped configuration with a head part 8 affixed to the support member 2 and a pair of arms 9 and 10 extending substantially perpendicularly from the ends of the head part and extending substantially perpendicularly to the plane of the support member as shown in FIG. 3.

Figure 4:
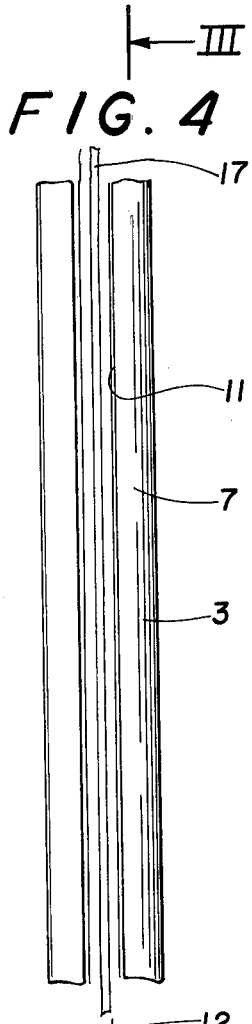
FIG. 4 is a view of part of one of the tubular members of the newspaper and magazine storage device of the invention.
Figure 5:
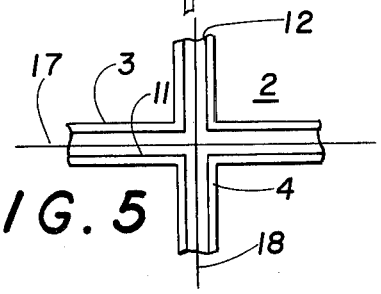
FIG. 5 is a view, on an enlarged scale, of the intersection of the tubular members at the top of the support member of the storage device of the invention.

Each of the tubular members 3 and 4 has a slit 11 and 12, respectively, formed therein along the length thereof, as shown in FIG. 5. Thus, as shown in FIG. 4, arm 7 of the tubular member 3 has a slit 11 formed along its length.

Each of the tubular members 3 and 4 is curved at both its free ends in a substantially hook-like configuration. Thus, as shown in FIGS. 1 and 2, the free ends of the tubular member 3 are curved in substantially hook-like configurations 13 and 14. As shown in FIGS. 2 and 3, the free ends of the tubular member 4 are curved in substantially hook-like configurations 15 and 16.

The slits 11 and 12 of the tubular members 3 and 4 accommodate cord-like binding material 17 and 18. The binding material 17 and 18 may comprise any suitable cord-like material, such as, for example, cord, string, wire, twine, rope, ribbon, and the like.

Since, as clearly shown in FIG. 5, the slits 11 and 12 open upward, the bundle 1 of newspapers and magazines lies thereover so that a cord, or the like, 17 in the tubular member 3 need merely be tied around the bundle in one direction and a cord, or the like, 18 in the tubular member 4 need merely be tied around the bundle in the direction at right angles to the cord 17, as shown in FIG. 2, to provide a securely bound bundle. The tubular members 3 and 4 hold a plurality of binding material, so that a plurality of bundles may be tied therewith. Each bundle is tied with a corresponding binding material or cord from the tubular member 3 and binding material or a cord from the tubular member 4.

A plurality of legs 19, 20, 21 and 22 may be affixed to the bottom of the support member 2 to raise the support member above a supporting surface 23 (FIG. 3). The legs 19 and 20 are shown in the view of FIG. 1 and the legs 20 and 21 are shown in the view of FIG. 3. The leg 22 is not shown in the FIGS.

The tubular members 3 and 4 are affixed to the top of the support member 2, as hereinbefore mentioned, by any suitable means such as, for example, screws. The tubular members 3 and 4 are maintained at substantially right angles to each other by the support member 2. The tubular members 3 and 4 may be separate members or may comprise an integral member.

While the invention has been described by means of a specific example and in a specific embodiment, I do not wish to be limited thereto, for obvious modifications will occur to those skilled in the art without departing from the spirit and scope of the invention.

I claim:

1. A newspaper and magazine storage device for storing and disposing of a plurality of newspapers and magazines, said storage device comprising a substantially rectangular plate-like support member; and a pair of tubular members affixed to the top of the support member and crossing each other on top of the support member at substantially right angles to each other, each tubular member extending along a corresponding axis of the support member and each tubular member having a substantially U-shaped configuration with a head part affixed to the support member and a pair of arms extending substantially perpendicularly from the ends of the head part and extending substantially perpendicularly to the plane of the support member, each of the tubular members having a slit formed therein along the length thereof for accommodating cord-like binding material in each of the tubular members, and each of the tubular members being curved at both its free ends in a substantially hook-like configuration.

2. A newspaper and magazine storage device as claimed in claim 1, further comprising a plurality of legs affixed to the bottom of the support member and raising the support member above a supporting surface.

* * * * *